US009913769B2

(12) United States Patent
Bliem

(10) Patent No.: US 9,913,769 B2
(45) Date of Patent: Mar. 13, 2018

(54) ITEM OF SEATING FURNITURE

(71) Applicant: Martin Bliem, Bad Ischl (AT)

(72) Inventor: Martin Bliem, Bad Ischl (AT)

( * ) Notice: Subject to any disclaimer, the term of this patent is extended or adjusted under 35 U.S.C. 154(b) by 146 days.

(21) Appl. No.: 15/024,307

(22) PCT Filed: Sep. 16, 2014

(86) PCT No.: PCT/EP2014/069666

§ 371 (c)(1),
(2) Date: Mar. 23, 2016

(87) PCT Pub. No.: WO2015/040008

PCT Pub. Date: Mar. 26, 2015

(65) Prior Publication Data

US 2016/0310334 A1 Oct. 27, 2016

(30) Foreign Application Priority Data

Sep. 23, 2013 (AT) ..... A50606/2013

(51) Int. Cl.
*A61G 5/14* (2006.01)
*A61G 5/10* (2006.01)
*A47C 3/22* (2006.01)

(52) U.S. Cl.
CPC ..... *A61G 5/14* (2013.01); *A47C 3/22* (2013.01); *A61G 5/1059* (2013.01)

(58) Field of Classification Search
CPC ..... A61G 5/14; A61G 5/1059; A47C 3/22
See application file for complete search history.

(56) References Cited

U.S. PATENT DOCUMENTS 974,769 A 11/1910 Hoff
3,774,963 A * 11/1973 Lowe ..... B60N 2/502 248/584
4,637,654 A * 1/1987 Boardman ..... A61G 5/14 297/337

(Continued)

FOREIGN PATENT DOCUMENTS

CA 1285860 C 7/1991
CH 553561 A 9/1974

(Continued)

OTHER PUBLICATIONS

State Intellectual Property Office of the Peoples Republic of China, Office Action and Search Report Issued in Application No. 201480059022.3, dated Mar. 30, 2017, 14 pages. (Submitted with Partial Translation).

(Continued)

*Primary Examiner* — David E Allred
(74) *Attorney, Agent, or Firm* — McCoy Russell LLP

(57) ABSTRACT

An item of seating furniture having a sitting surface which is mounted on a frame structure and which can be lifted from a lower position to an upper position by means of a lifting device, said lifting device having a scissors mechanism that has at least two limb parts which can pivot relative to each other. At least one spring element which is prestressed in the lower position, acts in the direction of the upper position and can be arranged in at least two different angular positions engages with at least one of the limb parts which is mounted via an articulated joint to the frame structure.

18 Claims, 10 Drawing Sheets

(56) References Cited

U.S. PATENT DOCUMENTS

| | | | | |
|---|---|---|---|---|
| 4,856,763 | A * | 8/1989 | Brodersen | B60N 2/502 248/564 |
| 4,979,726 | A | 12/1990 | Geraci | |
| 5,011,109 | A * | 4/1991 | Nagata | B60N 2/502 248/564 |
| 5,794,911 | A * | 8/1998 | Hill | B60N 2/502 248/419 |
| 5,927,679 | A * | 7/1999 | Hill | B60N 2/502 248/421 |
| 6,186,467 | B1 | 2/2001 | Wahls | |
| 7,810,884 | B2 * | 10/2010 | Lorey | B60N 2/501 297/344.16 |
| 7,891,696 | B2 * | 2/2011 | Hanson | A61G 5/08 280/47.41 |
| 9,688,173 | B2 * | 6/2017 | Ulrich | B60N 2/52 |
| 9,789,793 | B2 * | 10/2017 | Abe | B60N 2/3011 |

FOREIGN PATENT DOCUMENTS

| | | | |
|---|---|---|---|
| CN | 101238933 | A | 8/2008 |
| CN | 101365366 | A | 2/2009 |
| CN | 101868167 | A | 10/2010 |
| CN | 102309382 | A | 1/2012 |
| CN | 202490113 | U | 10/2012 |
| DE | 4201349 | A1 | 7/1993 |
| FR | 2519861 | A1 | 7/1983 |
| GB | 1406420 | A | 9/1975 |
| WO | 2011144507 | A1 | 11/2011 |

OTHER PUBLICATIONS

ISA European Patent Office, International Search Report Issued in PCT Application No. PCT/EP2014/069666, dated Dec. 18, 2014, WIPO, 6 pages.

* cited by examiner

ITEM OF SEATING FURNITURE

The invention relates to an item of seating furniture with a sitting surface which is mounted on a frame structure and which can be lifted from a lower position to an upper position by means of a lifting device.

In order to make it easier for older persons or persons with impaired mobility to sit down on an item of seating furniture or to get up from an item of seating furniture devices have become known in which the sitting surface of the item of seating furniture is adjustable in height.

From WO 2011/144507 A1 an item of seating furniture of this type with such an aid for standing up is known in which spring elements are arranged in the chair legs. When standing up the sitting surface is raised as a result of the spring force and tilted forwards which makes it easier to leave the item of seating furniture. Sitting down in the item of seating furniture is also made more comfortable.

This item of seating furniture has become well established in practice in order to make it possible for persons with restricted mobility to sit down and stand up by themselves.

Compared with this, the aim of the present invention is to create a cost-effectively manufacturable item of seating furniture of the type described in the introduction, in which the natural course of movement during standing up or sitting down is supported with simply designed means.

In accordance with the invention the lifting device has a scissors mechanism with at least two limb parts which can pivot relative to each other, wherein an actuator acts on at least one of the limb parts.

Accordingly, for raising the sitting surface the item of seating furniture according to the invention comprises a scissors mechanism which has at least two limb parts which can be pivoted about a common pivot axis. The limb parts are arranged between the frame structure and the sitting surface so that the sitting surface can be moved between the lower position and the upper position by means of the limb parts. To support the standing up movement, the scissors mechanism arranged preferably under the sitting surface is connected to an actuator so that the sitting surface is lifted with the aid of the actuator. In the lower position of the sitting surface the limb parts are arranged at a first smaller angle and in the upper position at a second, greater angle with regard to each other. With this the natural course of movement when standing up from the seating furniture can be advantageously supported. Furthermore, entry to the item of seating furniture is facilitated. If the user sits on the raised sitting surface and then displaces his/her weight backwards, the sitting surface is moved into the lower position. The lower position of the sitting surface is therefore set up as the sitting position, whereas the upper position of the sitting surface is designed as the getting on or getting off position. With the aid of the scissors mechanism a simply designed aid for standing up and sitting down is created in an advantageous manner which has also proven to be particularly stable and reliable. In addition, the item of seating furniture can be produced at comparatively low cost through which the distribution of barrier-free seating furniture can be promoted.

Envisaged as the actuator in accordance with a particularly preferred embodiment is a spring element, which is pre-stressed in the lower position and acts in the direction of the upper position. Alternatively, an electric motor, more particularly a spindle motor can be envisaged as the actuator.

In accordance with a particularly preferred embodiment the spring element can be arranged in at least two different angular positions. Accordingly the angle of contact between the spring element and the associated limb part can be changed through pivoting the spring element. In this way the force transmission onto the scissors mechanism can be advantageously adjusted. Preferably the spring element can be locked in the at least two angular positions.

In order to be able to adjust the lifting device to the weight of a user, it is of advantage if the pre-stressing of the spring element can be set in order to adjust the lifting force acting on the sitting surface. The pre-stressing of the spring element can, in particular, be adjusted by changing the compression of the spring element which compression is present in the lower position of the sitting surface. Hence, the pre-stressing of the spring element can be adjusted as a function of the weight of the user, through which the lifting force acting on the sitting surface can be influenced.

For force transmission between the spring element and the sitting surface it is beneficial if the one end of the spring element is supported in a spring bearing connected to the limb part and the other end of the spring element is supported in a counter-bearing connected to the frame structure. To adjust the spring force the bearing positions of the spring element can be moved towards each other, through which the compression of the spring element and thereby the spring force can be set. Particularly preferable is an embodiment in which the spring bearing is connected to the corresponding limb part of the scissors mechanism in an articulated manner so that the angular position of the spring element can be varied. Here, it is particularly beneficial if the bearing positions of the spring element are moved closer or further away from each other during pivoting of the spring element so that the spring force of the spring element can be changed accordingly.

To adjust the angular position of the spring element and to set the lifting force, it is of advantage if a least one control element is arranged between the counter-bearing of the spring element and the frame structure wherein the length of the control element can be varied. Through changing the length of the control element, the angular position of the spring element and the pre-stressing of the spring element can be adjusted in order to adapt the lifting force acting on the sitting surface during the standing up movement to the weight of the user.

To achieve the change in length of the control element it is beneficial if the spring element is connected to at least one control element for adjusting the angular position of the spring element and for setting the lifting force.

Here it is beneficial if the control element has at least two parts, which can be adjusted in the longitudinal direction in relation to each other, more particularly of a gas spring or of a threaded rod element. The parts of the control element can on the one hand be connected to each other via a thread. This embodiment has the advantage that the angular position of the spring element can be adjusted continuously. Alternatively the control element can have a manually releasable snap connection between the parts, which has at least two snap positions at a distance from each other in the longitudinal direction. The control element can also be in the form of a gas spring.

According to a preferred embodiment the control element is arranged between the counter-bearing of the spring element and the frame structure.

Alternatively the control element can be connected in an articulated manner to a connection arm which is connected in an articulated manner to the counter-bearing and the frame structure.

In order to simulate the natural course of movement when standing up or sitting down it is beneficial if the components of the lifting device, more particularly the limb parts of the scissors mechanism, are arranged in such a way that the lifting force between the lower and the upper position of the sitting surface is essentially constant, irrespective of the angular position of the spring element. Advantageously in this way, irrespective of the angular position of the spring element an essentially constantly acting force is achieved between the lower position and the upper position. Depending on the embodiment the lifting force can be influenced by various parameters, which include, in particular, the point of contact of the spring element on the associated limb part, the length relationship between the limb parts, the arrangement of the pivot axis between the limb parts and the length of the spring element. The individual parameters can be coordinated with regard to each other through routine experimental work so that the essentially constant force is achieved independently of the angular position of the spring element.

To transmit a lifting force to the sitting surface it is beneficial if the spring element has a helical spring. In the lower position of the sitting surface the helical spring is present in a compressed state. Preferably the compression of the helical spring can be adjusted by changing the angular position of the spring element in order to match the lifting force on the sitting surface to the weight of the user. Through releasing the helical spring the limb part attached thereto is pushed upwards so that the limb parts are pivoted with regard to each other in order to move the sitting surface into the upper position.

Preferably the spring element is connected to a damper element, more particularly a gas pressure spring or an oil damper, wherein the damper element is preferably arranged inside the spring element. With the aid of the damper element, in particular the lifting of the sitting surface is dampened, which reliably prevents the user being jolted out of the item of seating furniture. In this way, a particularly simple and safe design of the item of seating furniture can be achieved.

In order to fix the sitting surface in a predefined position, it is beneficial if the damper element can be blocked for locking the sitting surface. Preferably the damper element can be blocked in any position of the sitting surface, but more particularly in the lower position of the sitting surface. This embodiment has the advantage that the sitting surface can also be fixed when no weight is acting on the sitting surface.

For the manual blocking and release of the damper element it is beneficial if the blockable damper element is connected via a connection, more particularly a tension cable, with an activating device, preferably in the area of an arm rest.

In accordance with a preferred embodiment the sitting surface is designed in one part, wherein in the upper position the sitting surface is arranged essentially horizontally or arranged to slope forwards.

In accordance with a further preferred embodiment the one limb part engages on a front sitting area and the other limb part on a rear sitting area of the sitting surface, wherein the front and rear sitting area are connected to each other in an articulated manner. In this embodiment of the invention it is preferably envisaged that the front edge of the front sitting area of the sitting surface is rounded in design.

If the front and rear sitting area in the lower position of the sitting surface are essentially arranged in one plane, wherein the front sitting area in the upper position of the sitting surface is inclined downwards towards the rear sitting area, sitting down and standing up can be facilitated further. In the upper position the rear sitting area is preferably arranged horizontally or tilted slightly forward from the horizontal.

In order to allow for pivoting of the limb parts when lifting or lowering the sitting surface, at least one of the limb parts is preferably connected in an articulated manner to a crank lever which is mounted on the frame structure via an articulated joint. In this way blocking of the limb parts can be prevented in a particularly simple way. Alternatively, at least one of the limb parts could be borne in a guide connected with the frame structure.

To transfer particularly high lifting forces to the sitting surface it is advantageous if the scissors mechanism, preferably on the opposite longitudinal sides of the sitting surface, has at least two pairs of limb parts that can be pivoted with regard to each other.

In accordance with a particularly user-friendly embodiment, chair legs with castors are provided which castors are each connected to a braking device for blocking the castors. In this way the item of seating furniture can be moved in a particularly simple manner. With the aid of the braking device the item of seating furniture can be fixed in its position, which is of particular advantage if the person wants to sit down in or wants to stand up from the item of seating furniture. It is particularly preferable if the at least one braking device interacts with the height position of the sitting surface in such a way that the braking device is automatically brought into the blocked state as soon as the sitting surface has been raised a predetermined distance from the lower position. According to an alternative embodiment it is envisaged that the item of seating furniture is fitted with a brake lever that can be operated by the user. On operating the lever a tension cable extending into the castors is activated and releases the braking device there.

BRIEF DESCRIPTION OF THE FIGURES

The invention will be described in more detail below by means of a preferred example of the embodiment shown in the drawings, to which, however, it is not restricted. In detail, in the drawings.

DETAILED DESCRIPTION

Figure 1:
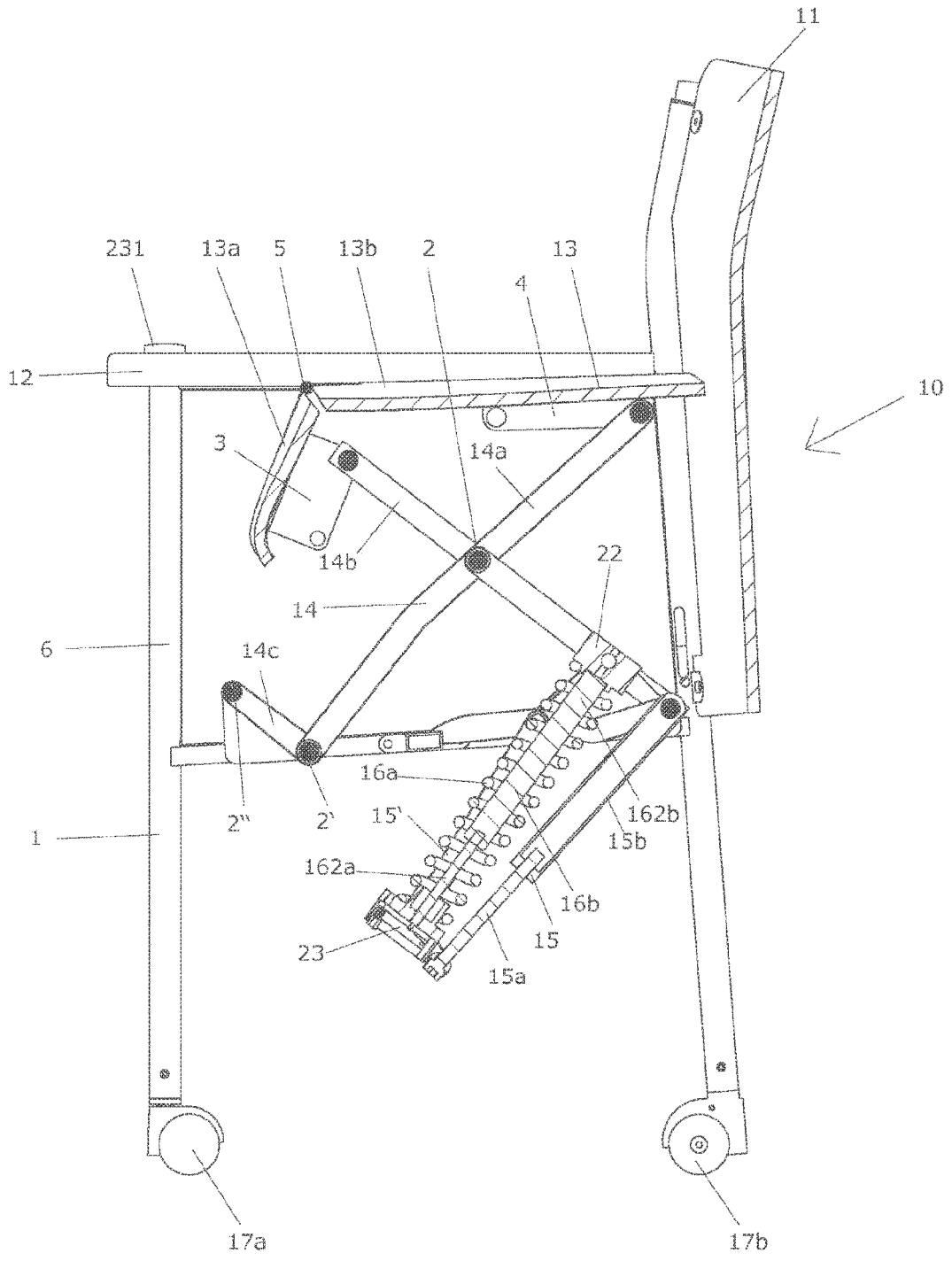
FIG. 1 shows a side view in partial cross-section of an item of seating furniture in accordance with the invention, with a scissors mechanism to raise the sitting surface, wherein a spring element acting on the scissors mechanism is arranged in a first angular position corresponding to a first, lesser lifting force.
Figure 2:
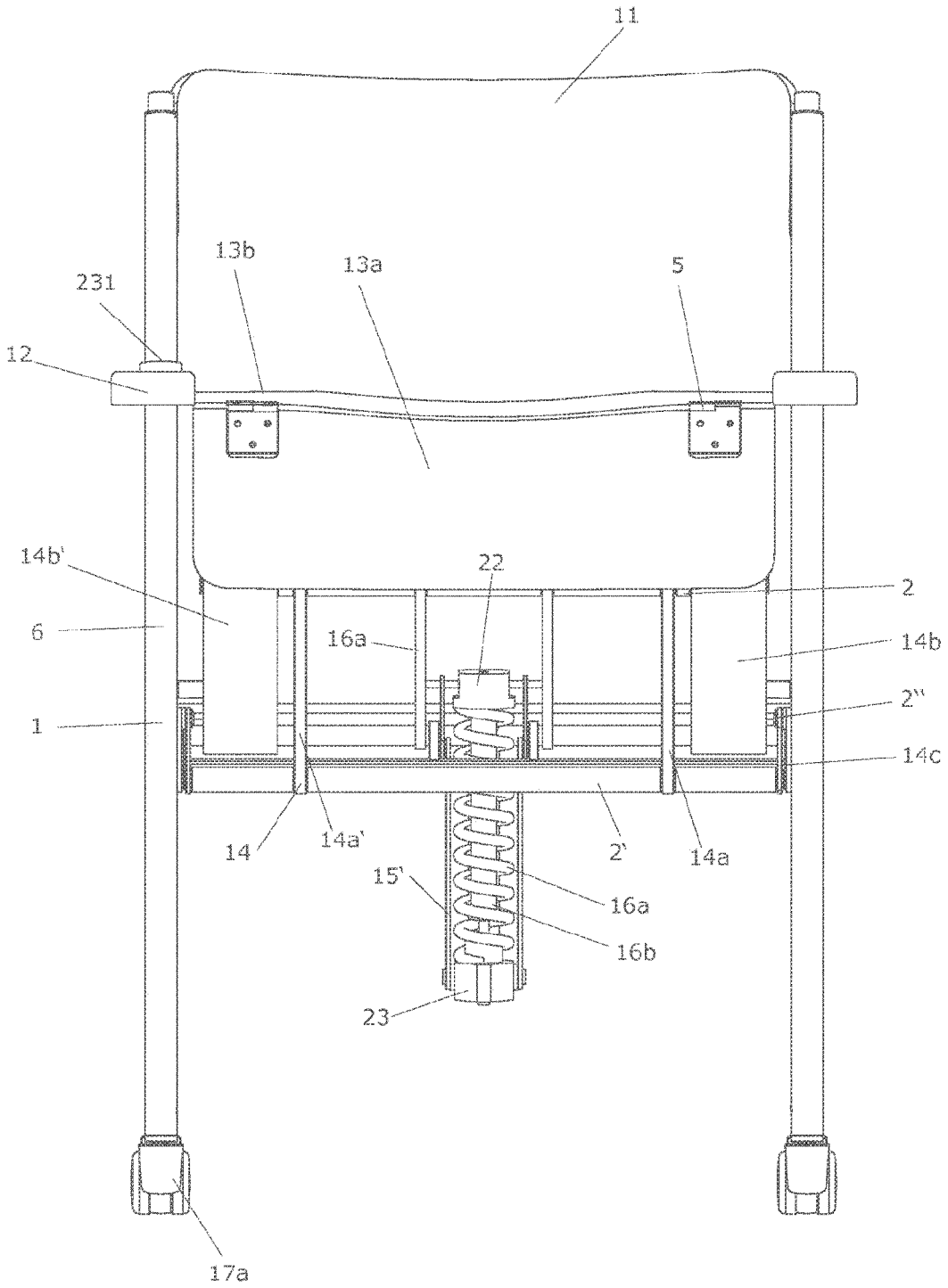
FIG. 2 shows a view of the item of seating furniture in FIG. 1 from the front.
Figure 3:
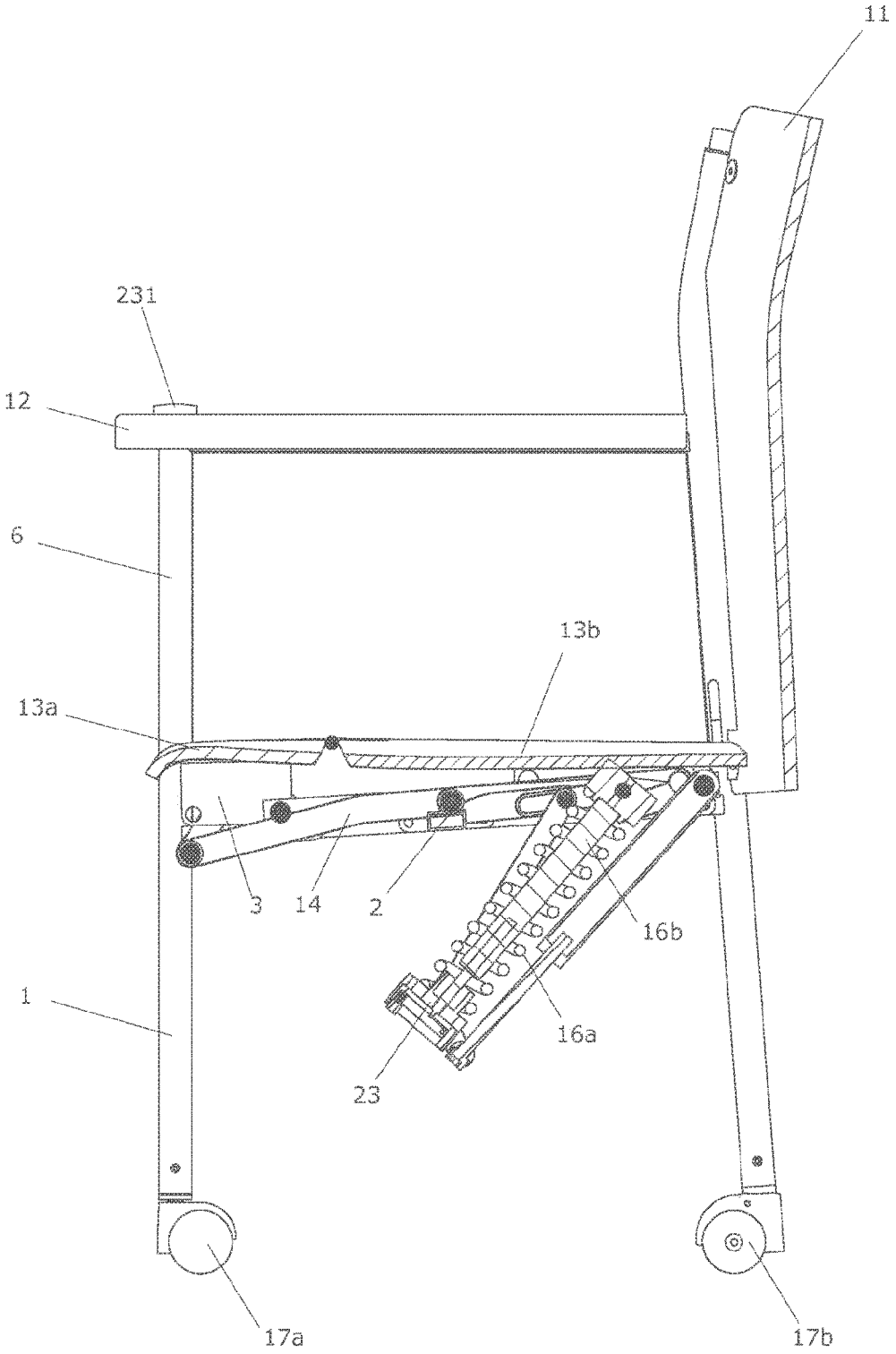
FIG. 3 shows a side view of the item of seating furniture in accordance with FIG. 1, 2 with the sitting surface lowered.

In FIGS. 1 to 3 an item of seating furniture 10 is shown which comprises a frame structure 1, a backrest 11, arm rests 12 and a sitting surface 13. According to FIGS. 1, 2 the sitting surface 13 of the item of seating furniture 10 is arranged in a raised, or upper, position, which makes it easier for an impaired person to get up from the item of seating furniture 10 or to sit down in the item of seating furniture 10. According to FIG. 3 the sitting surface 13 of the item of seating furniture 10 is arranged in a lowered or lower position which corresponds to the essentially horizontal sitting position. To move the sitting surface 13 between the lower position (cf. FIG. 3) and the upper position (cf. FIGS. 1, 2) the sitting surface 13 is connected to a lifting device with which the natural course of movement when standing up or sitting down is supported.

As can also be seen from FIGS. 1 to 3, a scissors mechanism 14 is provided as the lifting device and acts between the underside of the sitting surface 13 and the frame structure 1. The scissors mechanism 14 has at least one pair of interacting limb parts 14*a*, 14*b*, wherein in the shown embodiment a further, identical, pair of limb parts 14*a*', 14*b*' is provided. The limb parts 14*a*, 14*b* and/or 14*a*', 14*b*' are hinged on opposite longitudinal sides of the sitting surface 13.

As can also be seen from FIGS. 1 to 3, the limb parts 14*a*, 14*b* are arranged so that they can be pivoted with regard to each other. For this, the limb parts 14*a*, 14*b* are pivotably arranged about a common axle 2 which is arranged approximately centrally on the limb parts 14*a*, 14*b*. In order to allow the pivoting of the limb parts 14*a*, 14*b* during the raising and lowering of the sitting surface 13, the one limb part 14*a* is connected via an articulated joint 2' to a crank lever 14*c* which, via an articulated joint 2", is mounted on the frame structure 1.

As can also be seen from FIGS. 1 to 3, the limb part 14*b* of the scissors mechanism 14 is connected with a spring element 16*a* which in the lower position of the sitting surface 13 (cf. FIG. 3) is pre-stressed so that the sitting surface 13 can be moved from the lower position into the upper position (cf. FIG. 1, 2) with the support of the spring element 16*a*. In the shown embodiment the spring element 16*a* is in the form of a helical spring which will be decompressed during the movement of the sitting surface 13 into the upper position. For force transmission to the limb part 14*b* the one end of the spring element 16*a* is held in a spring bearing 22 connected to limb part 14*b*, and the other end of the spring element 16*a* is held in a counter-bearing 23 connected with the frame structure 1.

As can also be seen from the drawing, the spring element 16*a* can be arranged in at least one first angular position (cf. FIGS. 1 to 3) and in a second angular position (cf. FIG. 4, 5) different to the first angular position. By changing the angular position of the spring element 16*a*, on the one hand the angle of contact of the spring element 15*a* on the limb part 14*b*, and also the pre-stressing of the spring element 16*a* can be adjusted, through which the lifting force on the sitting surface 13 can be matched to the weight of the user. For this, between the counter-bearing 23 of the spring element 16*a* and the frame structure 1 a control element 15 is arranged which can be adjusted in length in order to adapt the angular position of the spring element 16*a* and to set the lifting force. In the shown embodiment the control element 15 has two parts 15*a*, 15*b* which can be adjusted longitudinally with regard to each other, wherein the one part 15*b* is connected in an articulated manner to the frame structure 1 and the other part 15*a* is connected in an articulated manner to the counter-bearing 23. In addition, the counter-bearing 23 is attached in an articulated manner to the frame structure 1 by means of a connection arm 15'.

Figure 4:
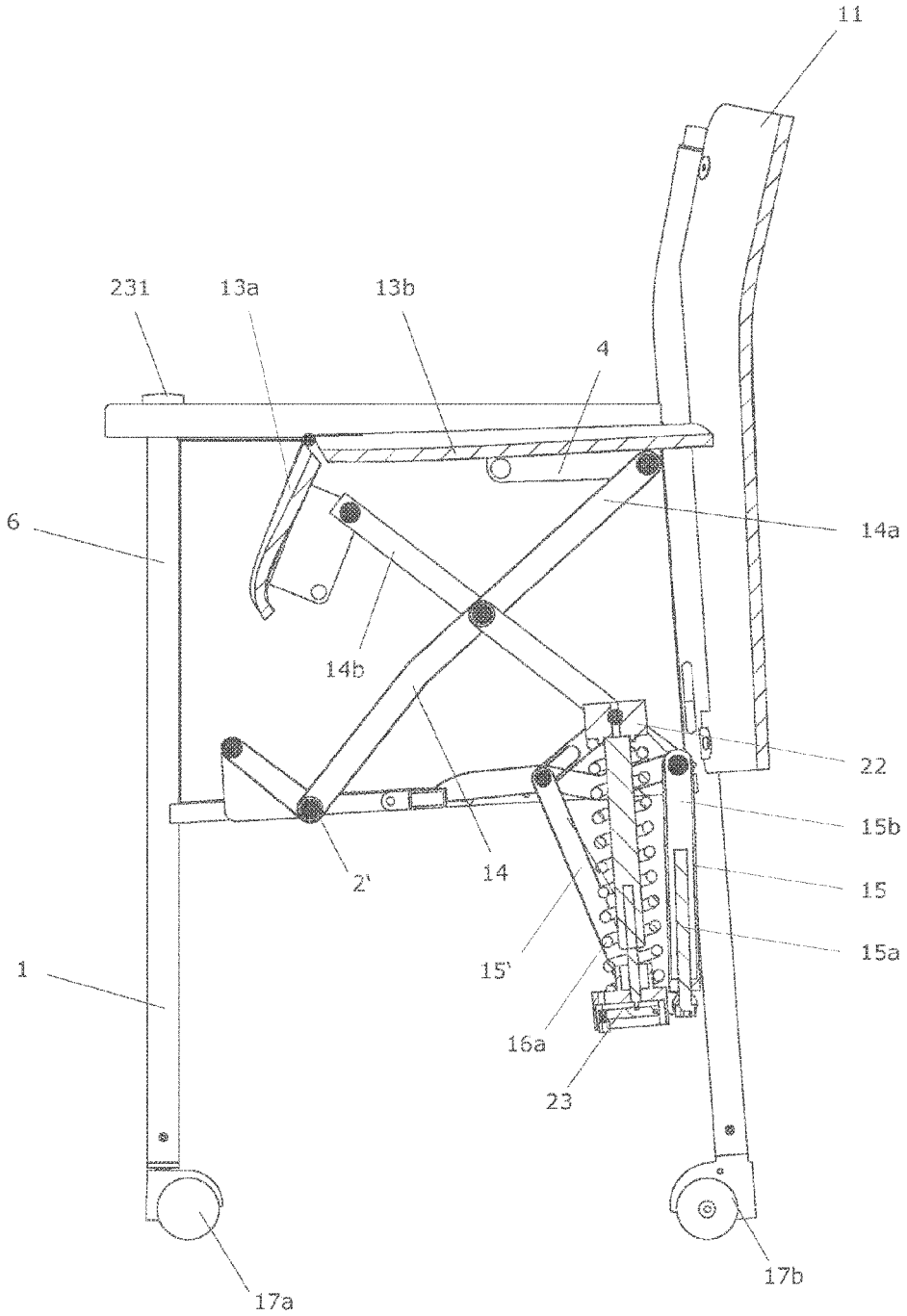
FIG. 4 shows a view of the item of seating furniture according to the invention corresponding to FIG. 1 with the sitting surface raised wherein to increase the lifting force acting on the sitting surface the spring element is pivoted into a second angular position corresponding to a second, greater lifting force.
Figure 5:
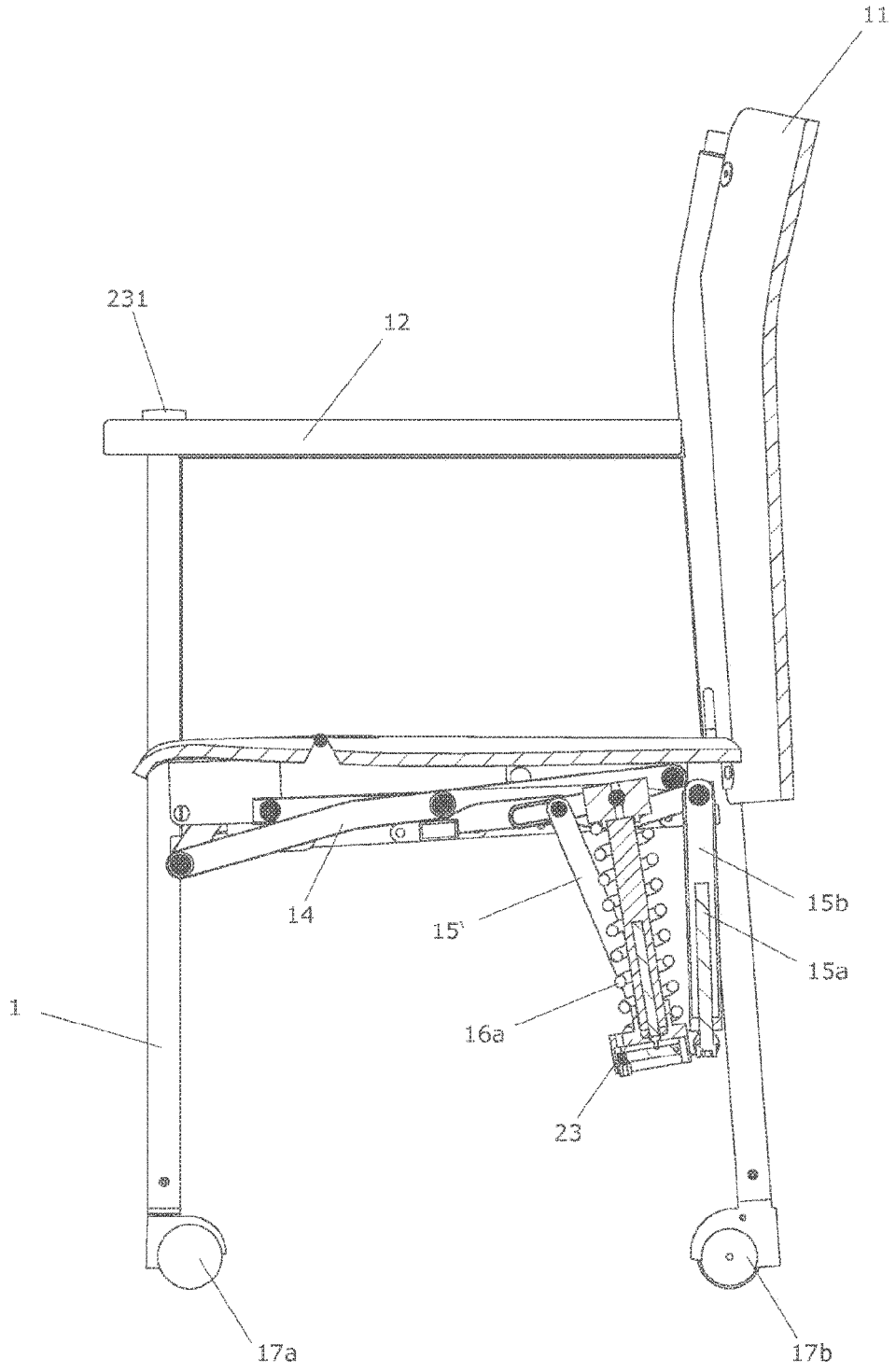
FIG. 5 shows a view of the seating furniture shown in FIG. 4 with the sitting surface lowered.

As can also be seen from the drawing, the spring element 16*a* can be pivoted from the first, more obtuse angular position shown in FIGS. 1 to 3, into the second, more acute, angular position shown in FIG. 4, 5. To pivot the spring element 16*a*, the parts 15*a* and 15*b* of the control element 15 are manually pushed into each other. According to FIGS. 1 to 6, parts 15*a*, 15*b* form a gas spring. By adjusting the control element 15 the distance, dependent on the length of the control element 15, between the spring bearing 22 and the counter-bearing 23 is shortened, through which the pre-stressing of the spring element 16*a* and thus the lifting force acting on the sitting surface 13 is increased. In this way the resulting lifting force can be specifically set via the angular position of the spring element 16*a*. The various components of the lifting device, more particularly the limb parts 14*a*, 14*b*, 14*a*', 14*b*' of the scissors mechanism 14 are arranged and connected to each other in such a way that the lifting force between the upper and the lower position of the sitting surface 13 is essentially constant—irrespective of the angular position of the spring element 16*a*.

As can also be seen from FIGS. 1 to 5, the spring element 16*a* interacts with a damper element 16*b* which is preferably in the form of a gas pressure spring or oil damper. The damper element 16*b* is arranged inside the spring element 16*a*. In the shown embodiment the damper element 16*b* has a cylinder 162*b* within which a piston rod 162*a* moves.

Figure 6:
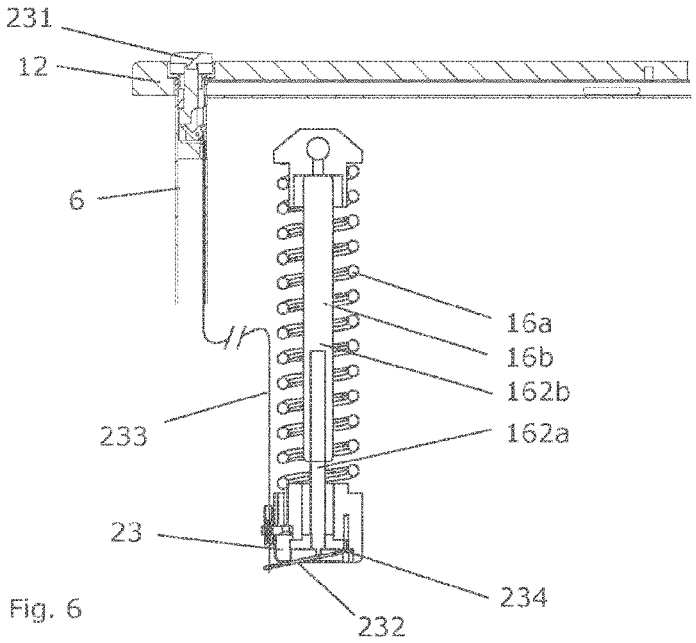
FIG. 6 shows a view of a preferred embodiment of the item of seating furniture in which the spring and/or damping element is connected via a tension cable to an activating device in the area of an arm rest of the item of seating furniture.
Figure 7:
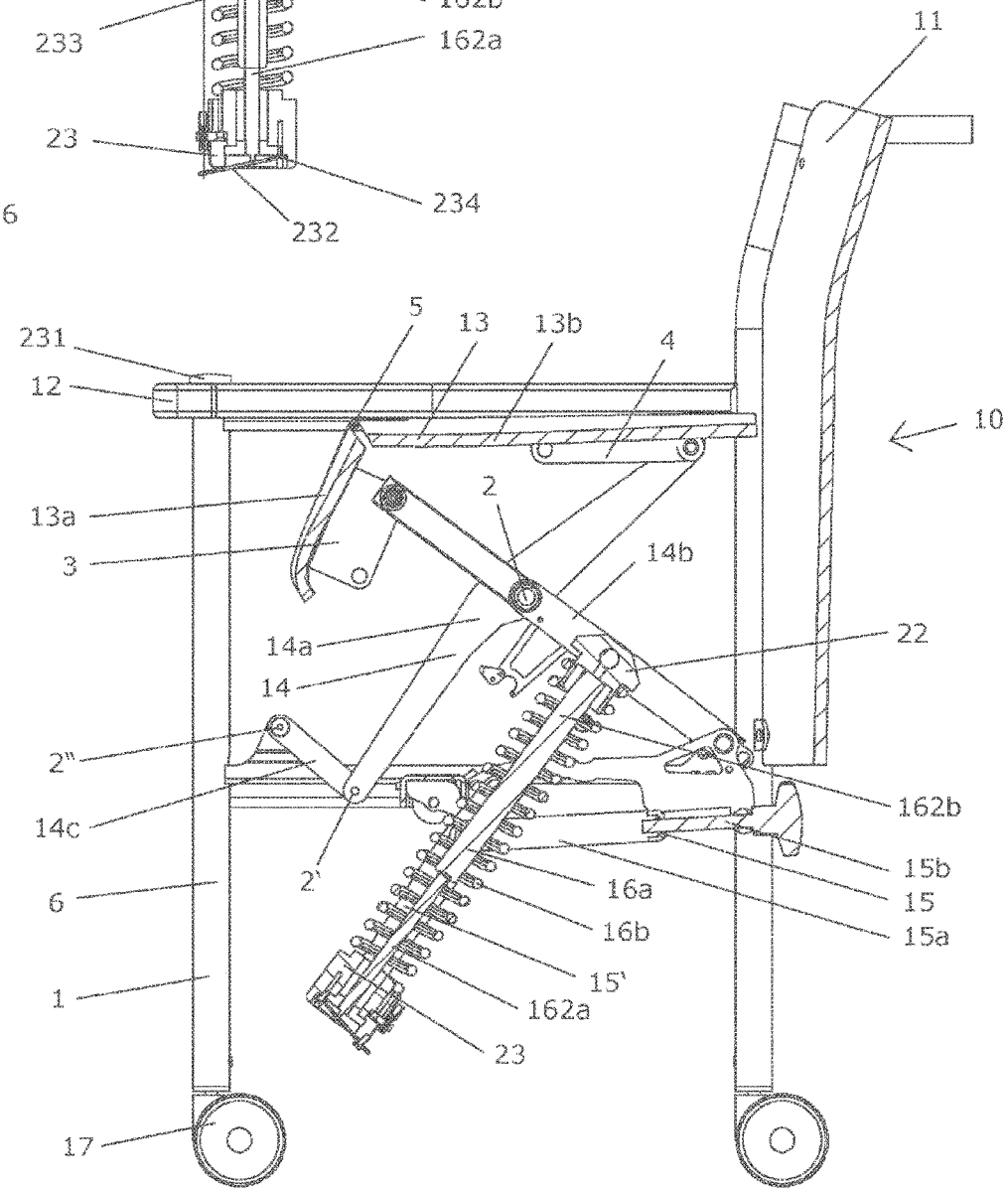
FIGS. 7 to 11 show views of an item of seating furniture corresponding to FIGS. 1 to 5 in an alternative form of embodiment of the invention.
Figure 8:
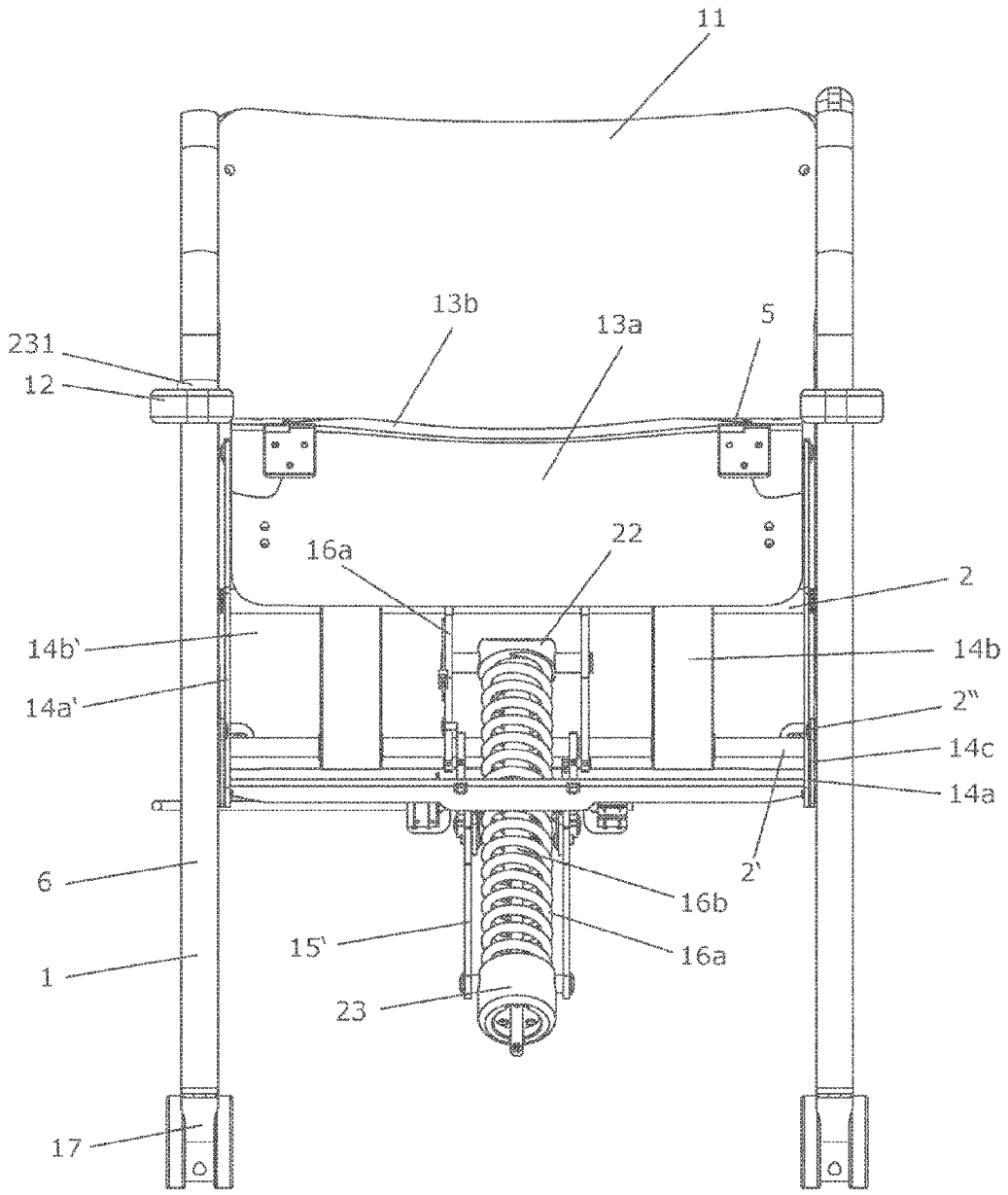
Figure 9:
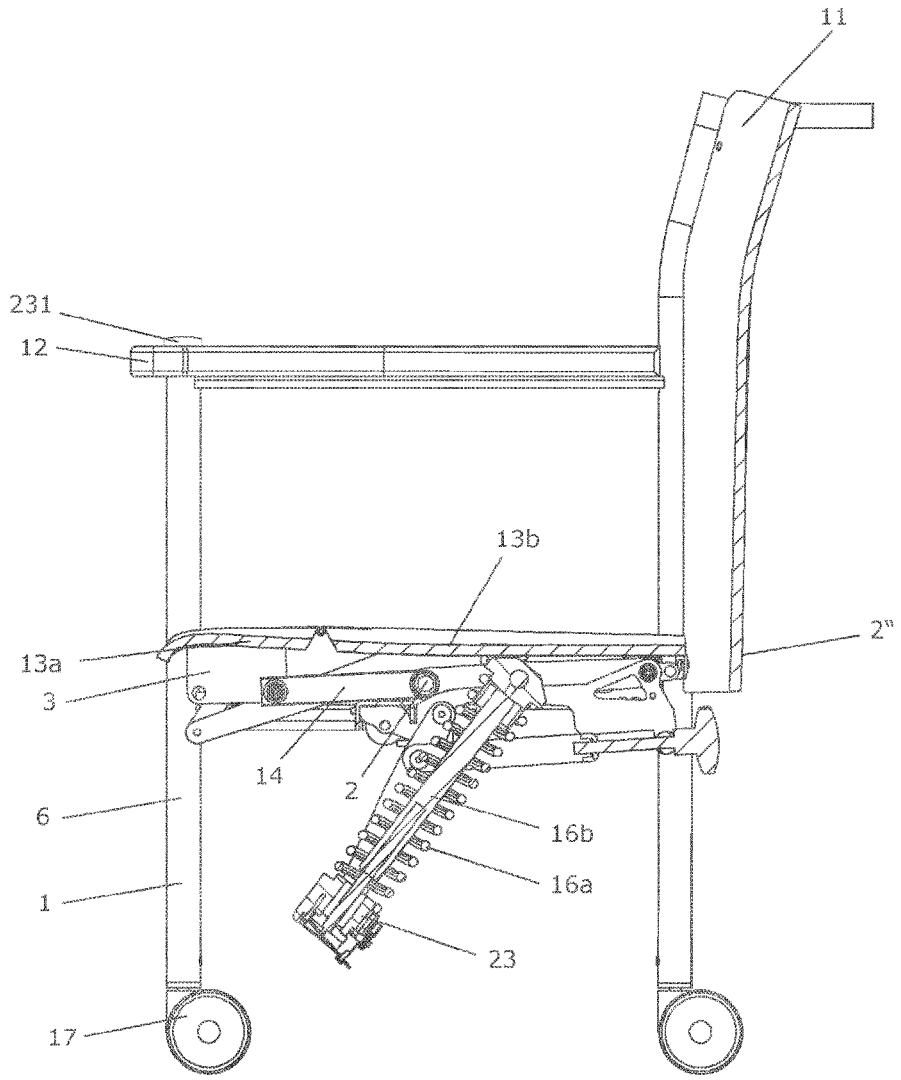
Figure 10:
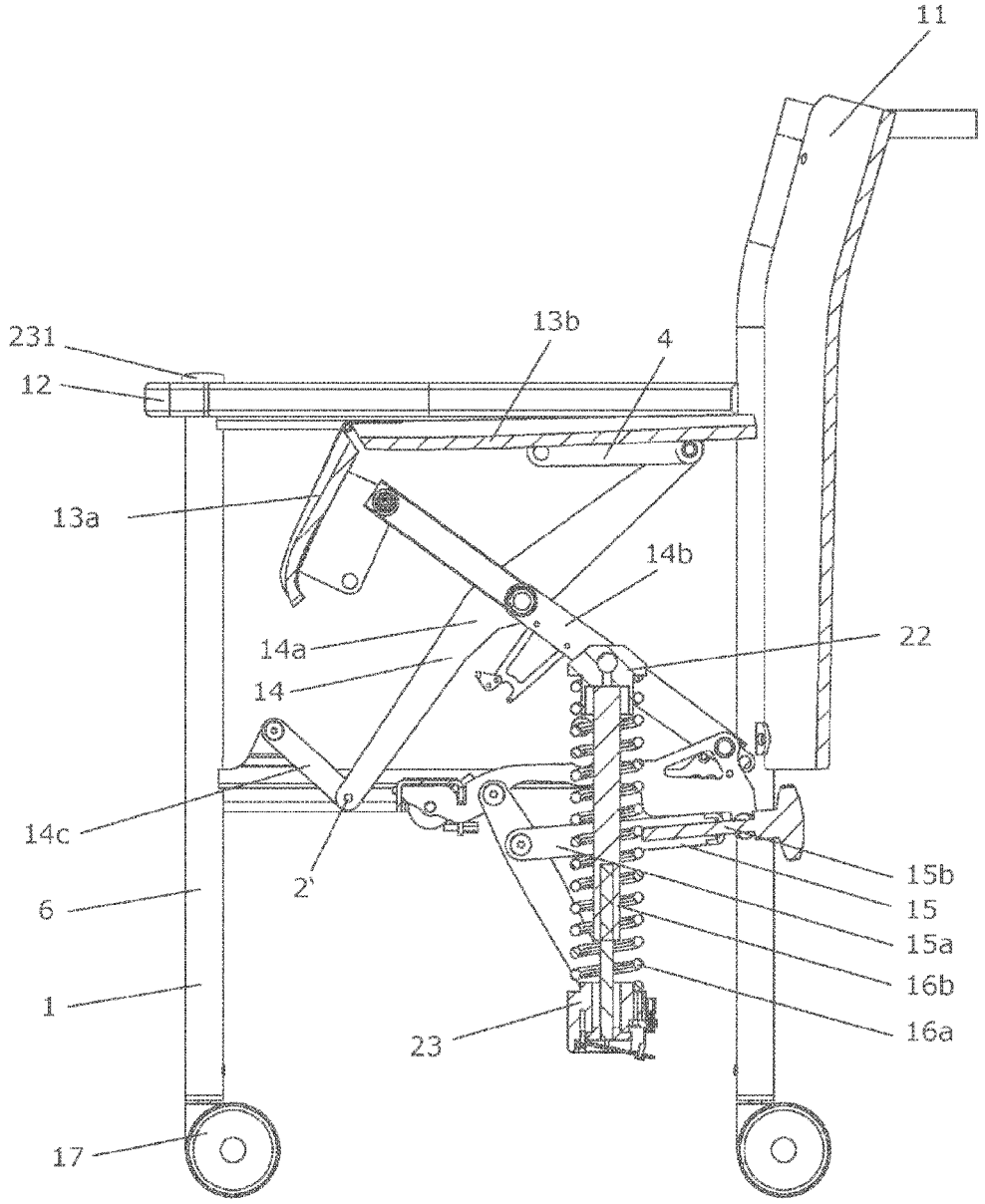
Figure 11:
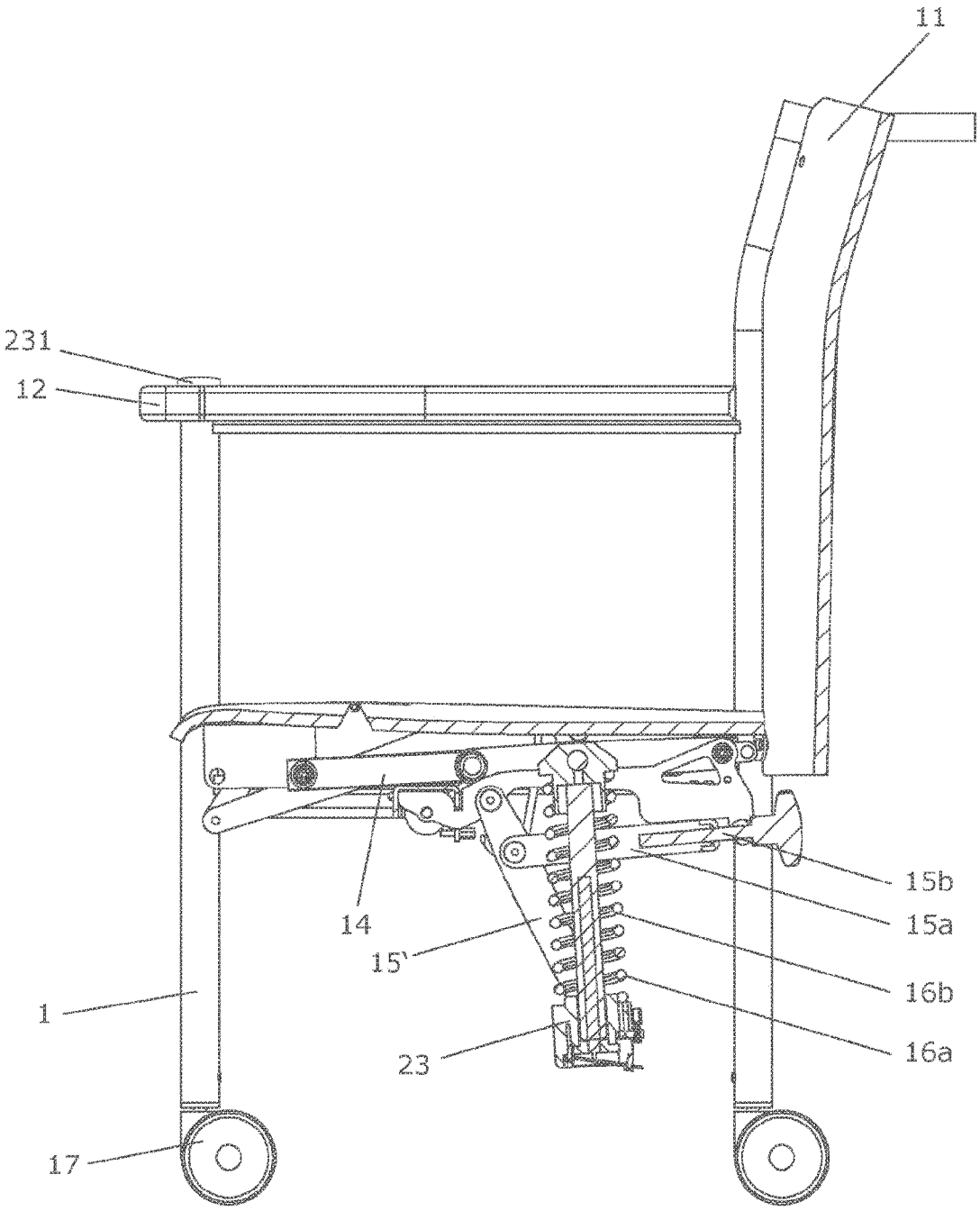

As can be seen from FIG. 6, the damper element 16*b* in the shown embodiment can be blocked, so that if required the sitting surface 13 can be locked in a predetermined height position. For locking or releasing, the blockable damper element 16*b* is connected via a connection 233, for example a tension cable, extending within a chair leg 6, to an activating device 231, which in the shown example of embodiment is located in a front end area of the arm rest 12. The movement of the activating device 231 is transmitted via the connection 233 to a lever 232 with articulated joint 234. The lever 232 presses against a corresponding activating element of the damper element 16*b*, through which the blocking of the piston rod 162*a* relative to the cylinder 162*b* is released. In the blocked stated of the damper element 16*b*, lifting of the sitting surface 13 can be advantageously prevented, if, for example, the person using the item of seating furniture 10 leans forwards to pick up an object from the floor and therefore takes the load off the sitting surface 13.

As can also be seen from FIGS. 1 to 5, the one limb part 14*a* is connected in an articulated manner via a profile part 3 to a front sitting area 13*a* and the other limb part 14*b* is connected in an articulated manner via a profile part 4 to a rear sitting area 13*b* of the sitting surface 13. The front 13*a* and the rear sitting area 13*b* are pivotably connected to each other via a joint 5. Through this further relieving of impaired persons can be achieved when they are sitting down. In the shown embodiment the front sitting area 13*a* has a front edge which is bent downwards. Additionally, the front sitting area 13*a* is much narrower than the rear sitting area 13*b*.

As can also be seen from FIGS. 1 to 5, in the lower position of the sitting surface 13 the front 13*a* and the rear sitting area 13*b* are essentially arranged in one plane. Linking of the front 13*a* and/or rear sitting area 13*b* via the limb parts 14*a*, 14*b* takes place in that the front sitting area 13*a* in the upper position of the sitting surface 13 is arranged inclined downwards with regard to the rear sitting area 13*b*. In the upper position the rear sitting area 13*b* is also lightly tilted down with regard to the horizontal.

As can also be seen from FIGS. 1 to 5 the item of seating furniture 10 has four chair legs 6, which are each provided with castors 17*a*, 17*b* for rolling the item of seating furniture 10 on a floor surface. Here it is envisaged that the front castors 17*a* are designed to be laterally pivotable, whereas the rear castors 17*b* are not laterally pivotably, but, instead, are each provided with a braking device 18. In order to prevent the item of seating furniture 10 rolling away backwards when a person is sitting down or standing up, the braking device 18 is provided which can block or release the rear castors 17*b* depending on the setting. For this a manually operated braking lever can be provided with which the braking device 18 can be locked or unlocked.

In an alternative embodiment (not shown), it is envisaged that the braking device 18 is automatically blocked when the sitting surface 13 is raised by a predetermined distance, for example 40 mm, from the lower sitting position. In this way the item of seating furniture 10 is secured against an unintentional (backwards) movement, whereas at the same time a movement forwards can take place without perceptible resistance.

In FIGS. 7 to 11 an alternative embodiment of the invention is shown in which in the following only the differences with regard to the embodiment according to FIGS. 1 to 6 are described. In this embodiment the control element 15 also has parts 15*a*, 15*b* which can be adjusted with regard to each other, but which together form a threaded rod element. The threaded rod element can be adjusted with a hand wheel or an Allen key in order to match the angular position of the spring element 16 to the weight of the user.

The invention claimed is:

1. An item of seating furniture with a sitting surface mounted on a frame structure and which is liftable from a lower position to an upper position with a lifting device, wherein the lifting device has a scissors mechanism with at least two limb parts which pivot relative to each other, wherein an actuator, arranged in at least two different angular positions, acts on at least one of the limb parts; wherein the actuator is a spring element pre-stressed in the lower position and acts in a direction of the upper position, wherein one end of the spring element is held in a spring bearing connected to one of the limb parts and the other end of the spring element is held in a counter-bearing connected to the frame structure by a connecting member suspended at a first end of the connecting member relative to the frame structure and pivotally supporting the counter-bearing at a second end of the connecting member.

2. The item of seating furniture according to claim 1, wherein the spring element is connected to at least one control element for adjusting an angular position and a lifting force of the spring element.

3. The item of seating furniture according to claim 2, wherein the control element has at least two parts, adjustable relative to each other in a longitudinal direction.

4. The item of seating furniture according to claim 2, wherein the control element is arranged between the counter-bearing of the spring element and the frame structure.

5. The item of seating furniture according to claim 2, wherein the control element is connected in an articulated manner to a connection arm, wherein the connection arm is connected in an articulated manner to the counter-bearing of the spring element and the frame structure.

6. The item of seating furniture according to claim 2, wherein the limb parts are arranged in such a way that the lifting force between the upper position and the lower position of the sitting surface is constant irrespective of the angular position of the spring element.

7. The item of seating furniture according to claim 1, wherein the spring element is connected to a damper element arranged in an inside of the spring element.

8. The item of seating furniture according to claim 7, wherein the damper element is blocked to lock the sitting surface.

9. The item of seating furniture according to claim 8, wherein the damper element is connected via a connection to an activating device in an area of an arm rest, wherein the connection is a tension cable.

10. The item of seating furniture according to claim 1, wherein one limb part of the at least two limb parts engages on a front sitting area and the other limb part of the at least two limb parts engages on a rear sitting area of the sitting surface, wherein the front sitting area and the rear sitting area are connected to each other in an articulated manner.

11. The item of seating furniture according to claim 10, wherein the front sitting area and the rear sitting area in the lower position of the seating surface are arranged in one plane, wherein the front sitting area in the upper position of the sitting surface is arranged inclined downwards away from the rear sitting area.

12. The item of seating furniture according to claim 1, wherein at least one of the limb parts is connected in an articulated manner to a crank lever.

13. The item of seating furniture according to claim 3, wherein the control element is arranged between the counter-bearing of the spring element and the frame structure.

14. The item of seating furniture according to claim 5, wherein the limb parts are arranged in such a way that the lifting force between the upper position and the lower position of the sitting surface is constant irrespective of the angular position of the spring element.

15. The item of seating furniture according to claim 9, wherein one limb part of the at least two limb parts engages on a front sitting area and the other limb part of the at least two limb parts engages on a rear sitting area of the sitting surface, wherein the front sitting area and the rear sitting area are connected to each other in an articulated manner.

16. The item of seating furniture according to claim 11, wherein at least one of the limb parts is connected in an articulated manner to a crank lever.

17. The item of seating furniture according to claim 3, wherein the control element is a gas spring or a threaded rod element.

18. The item of seating furniture according to claim 7, wherein the damper element is a gas pressure spring or an oil damper.

* * * * *